United States Patent [19]

Swiatek

[11] 4,163,647

[45] Aug. 7, 1979

[54] METHOD FOR PRODUCING COATED ABRASIVES

[75] Inventor: Henry J. Swiatek, Schenectady, N.Y.

[73] Assignee: Norton Company, Worcester, Mass.

[21] Appl. No.: 516,215

[22] Filed: Oct. 21, 1974

Related U.S. Application Data

[63] Continuation of Ser. No. 346,314, Apr. 5, 1973, abandoned, which is a continuation of Ser. No. 156,046, Jun. 23, 1971, abandoned, which is a continuation of Ser. No. 744,218, Jul. 11, 1968, abandoned.

[51] Int. Cl.[2] ..... C09K 3/14

[52] U.S. Cl. ..... 51/295; 51/298; 51/301; 427/390 R; 427/428

[58] Field of Search ..... 51/295, 298, 297, 301; 427/386, 390, 428

[56] References Cited

U.S. PATENT DOCUMENTS

| | | | |
|---|---|---|---|
| 1,994,283 | 3/1935 | Martin | 51/295 |
| 2,128,907 | 9/1938 | Benner et al. | 51/298 |
| 2,740,725 | 4/1956 | Ball | 51/295 |
| 2,937,955 | 5/1960 | Loomer | 427/428 |
| 3,016,294 | 1/1962 | Haywood | 51/298 |
| 3,020,139 | 2/1962 | Camp et al. | 51/295 |

*Primary Examiner*—Donald J. Arnold

*Attorney, Agent, or Firm*—Arthur A. Loiselle, Jr.

[57] ABSTRACT

A process for making cloth backing for coated abrasive articles is disclosed wherein a backing material is coated on its front side, with a liquid thermosetting resin, in such a manner that the resin does not permeate the interstices of the cloth. As a result, the cloth retains most of its original pliability when incorporated in the finished coated abrasive article. A back sizing, of for example glue, may also be applied in the same manner to provide a coated abrasive backing material which is both front sized and back sized but which still possesses most of its original pliability.

5 Claims, 4 Drawing Figures

METHOD FOR PRODUCING COATED ABRASIVES

This is a continuation of pending application Ser. No. 346,314, filed Apr. 5, 1973 now abandoned which is a continuation of Ser. No. 156,046 filed June 23, 1971 which in turn is a continuation of Ser. No. 744,218 filed July 11, 1968, the latter two applications are now abandoned.

DEFINITIONS

The term "coated abrasive" is used herein to include any coated abrasive product or article, e.g., sheets or webs, belts, cones, discs, etc.

The term "woven cloth backing" is employed in a broad sense and is intended to encompass a woven fabric of any construction formed from yarns, strands, or fibers of any material, natural or synthetic, and which may be formed from multifilaments, monofilaments, staple, or the like.

By the term "interstices" is meant the interstices, openings, mesh, etc., formed by the intersecting warp and fill yarns in the woven cloth backing.

BACKGROUND OF THE INVENTION (1) Field of the Invention

This invention relates to coated abrasives and to the method of their manufacture. More specifically, the invention is concerned with a finished cloth particularly suitable for use as a backing in a coated abrasive, and in its method of manufacture.

(2) Description of the Prior Art

Basically, a coated abrasive comprises a backing, a maker adhesive to secure abrasive grain to the backing, and a sand size or adhesive layer to more firmly secure the abrasive grains in position.

A backing suitable for use in a coated abrasive must exhibit not only good adhesion with the maker adhesive but must also resist migration of the maker adhesive. If the maker adhesive migrates into the backing on which it is coated, there results a backing having physical properties similar to those of the maker adhesive. Thus, in the case of a heat-hardenable resin maker adhesive, migration results in the backing becoming stiff and hard, thereby destroying to a certain degree the natural pliability of the backing. Such embrittlement of the backing contributes to its failure in use, and moreover results in relatively low tear strength in the backing because of lack of mobility of the individual yarns.

Pliability, tear strength, and the like physical properties are valuable features in a coated abrasive; therefore, any means or method used to improve such physical properties is of distinct importance and advantage and constitutes an improvement in the art.

Heretofore, numerous means have been employed for producing coated abrasives of improved physical properties, none of which have met with universal success. One such means involves the provision of an immiscible, flexible barrier coat on the backing onto which is applied the heat-hardenable maker adhesive. Others have suggested, among other things, lighter-weight backings and the addition of plasticizers to the maker adhesive. Filling a cloth backing with a starch-base material, and treating such filled cloth with a very thin and "green" synthetic resin in preparation to coating the thus-treated cloth with a heat-hardenable "maker" coat is disclosed in U.S. Pat. No. 2,805,136.

Current practice in essentially all cloth finishing of backings for coated abrasives generally involves treatment of the cloth backing with aqueous dispersions of various kinds of filling material, such as starch, glue or clay. Combination treatments, often involving one or more back filling, back sizing, front sizing, etc. operations, are deemed important and necessary operations when a relatively rigid, hard and brittle maker adhesive is employed to secure the abrasive grains to the backing. A primary purpose of such finishing operations is to prevent migration of the maker adhesive into the backing, thus preventing embrittlement of the same. Embrittlement, as before mentioned, adversely affects pliability and tear strength of the coated abrasive. A secondary consideration in preventing migration of maker adhesive is anchorage of abrasive grain. Migration can result in depletion of the amount of adhesive in the maker layer to such an extent that anchorage of the abrasive grains to the backing is adversely affected.

Various methods and apparatus are used in finishing cloth, i.e., in back filling, back and front sizing. Two methods commonly used involve using a "Tommy Dodd" and a two-roll padder. Using a "Tommy Dodd", the cloth backing is forwarded on the surface of a roll partially immersed in a solution of the back filling material. The cloth on immersion is saturated by and picks up the solution in the interstices of the cloth and on its outer surface. On emergence from the vessel containing the back fill solution, the wet cloth, still on the roll, is passed through a narrow opening formed by a sharp-edged blade positioned adjacent to and at an angle with respect to the roll surface. The back fill material is more or less "pounded" into the cloth backing by virtue of the blade pressing against it. In a two-roll padder, the cloth backing is passed through the nip formed by, e.g., two vertically disposed rolls. The back size, for example, is picked up on the surface of the bottom roll which rotates in a tank containing a solution of the size, and is forwarded to the nip formed by the rolls. At the nip, the size is pushed or pounded, by the applicator roll, into the cloth backing.

Such finishing procedures have been selected in the past because, by the very nature of such, the finishing material must necessarily go into and fill up the openings and interstices in the cloth backing, thus leaving no place to which the maker can migrate. Moreover, to ensure more or less complete impregnation by the finishing materials, it has been common practice in the past to dry the coating materials by passing the wet coated surface in contact with a steam-heated drum, can, or the like. Such manner of drying results, as one might expect, in further and more complete migration of the filling and/or size material into the yarns and interstices of the cloth backing. With such finishing operations, the interstices of the cloth and the yarns are generally completely filled.

The finishing operations as above-mentioned are time-consuming and add materially to the cost of manufacture of the coated abrasive. Moreover, although the main object of such finishing operations is accomplished, i.e., migration of the maker adhesive is prevented, such finished cloth backing is attendant with other disadvantages.

Back filling, for example, while contributing to generally higher tensile properties, as compared with unfilled cloth, adversely affects, at least initially, tear strength and pliability, hence the over-all performance of the coated abrasive. On the other hand, a back fill is believed to have little influence on the physical properties of a coated abrasive once it has been in use for a relatively short period of time. Thus, back filling, it is believed, offers no real advantages and therefore ties up men and machinery unnecessarily. The use of a heat-hardenable resin size, however, which itself is allowed to migrate into and fill the backing, instead of the resin maker adhesive, makes for embrittlement of the backing and, it is believed, continually during the life of the coated abrasive affects pliability and tear strength in an adverse manner.

SUMMARY OF THE INVENTION

The present invention has as a principal object the solution of the above-mentioned prior art problems and disadvantages.

Another object is the provision of a new and improved cloth backing suitable for use in a coated abrasive.

A further object of the present invention is the provision of a finished cloth backing wherein the backing retains to a greater extent than heretofore the maximum natural pliability possessed by the cloth.

An additional object is the provision of a new and improved process for finishing cloth backings.

A further additional object is the provision of a new and improved coated abrasive characterized by increased tear strength.

Other objects and advantages of the present invention will be readily apparent from reading the present specification taken in conjunction with the accompanying drawings.

The objects of the present invention are accomplished in general by the provision of a backing comprising a woven cloth having warp and fill yarns intersecting to form interstices and a front size of a heat-hardenable resin deposited and sitting on the surface of the front side of the backing in a continuous layer but not penetrating to any substantial degree into the interstices of the backing, thereby leaving the interstices unfilled and the yarns with freedom of mobility.

The inventive process, hereinafter more fully described, is tailored to keep the sizing material out of the interstices of the cloth backing in order to gain and maintain improved pliability and tear strength, not only in the cloth backing per se but most importantly in the coated abrasive.

The discovery that a back filling operation is unnecessary, and, moreover, even undesirable, when a heat-hardenable maker adhesive is used is believed totally unexpected in view of the teachings of the prior art. Quite advantageously, the elimination of the back fill results in fewer processing steps, thereby resulting in lower costs in coated abrasive manufacture.

BRIEF DESCRIPTION OF THE DRAWINGS

The invention will be better understood by referring to the drawing in which like numerals refer to like parts in the several views and in which.

DETAILED DESCRIPTION OF THE PREFERRED EMBODIMENT

The finished cloth backing provided in accordance with the invention basically involves the application of a resin front size solution to a cloth backing in a wiping-like motion. The solution is then frictionally spread and made relatively smooth and is formed into a continuous layer on the surface of the cloth backing. After drying, the size is discovered to be deposited on the backing without substantial penetration into the interstices of the backing, thereby leaving the interstices unfilled and the yarns with freedom of mobility. The size does, however, penetrate to a slight degree the surfaces of the yarns directly adjacent.

In accordance with a more preferred embodiment of the invention, the finished cloth is additionally provided with a back size of glue, such, for reasons hereinafter made clear, being preferably applied to the backing before application of the resin front size. Such a back size provides for better abrasion resistance and can be, if desired, filled with an inert filler such as calcium carbonate. A further advantage in the provision of such a back size is improved dimensional stability.

Figure 1:
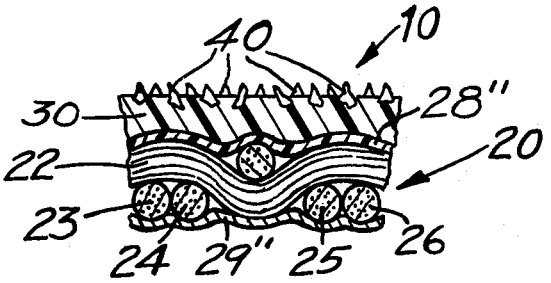
FIG. 1 is an enlarged view of a cross-section of a piece of a coated abrasive utilizing the cloth backing of the invention.

Turning now to the drawing, there is shown in FIG. 1, a coated abrasive product 10 utilizing the novel cloth backing 20 made in accordance with the process hereinafter more fully described. As is conventional, the product 10 is provided on the front or coat side of the backing with a maker adhesive designated by reference numeral 30 and by which abrasive grains 40 are adhered to the backing. A sand size coat, not shown in the drawings, can be provided, if desired.

Figure 2:
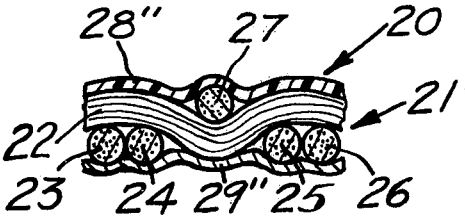
FIG. 2 is an enlarged view of a cross-section of a piece of the cloth backing of the invention.

The backing (FIG. 2) is a woven cotton cloth 21 having a weave pattern as shown by warp yarn 22 and fill yarns 23, 24, 25, 26 and 27. The cloth is treated in accordance with the more preferred embodiment of the invention to provide thereon a relatively thin, smooth continuous layer of a front size 28" and a relatively thin, smooth continuous layer of a back size 29". As indicated in the drawing, there is little penetration by the front and back sizes into the interstices formed by adjacent intersecting warp and fill yarns, thus leaving the interstices unfilled and the yarns with some freedom of movement if the backing is subjected to, e.g., a tearing stress. For the sake of clarity, the layers of size are shown merely in contact with the surfaces of the adjacent yarns; however, the size does penetrate the yarn surfaces to a slight degree. Such penetration is not, however, to the same extent as heretofore.

Figure 3:
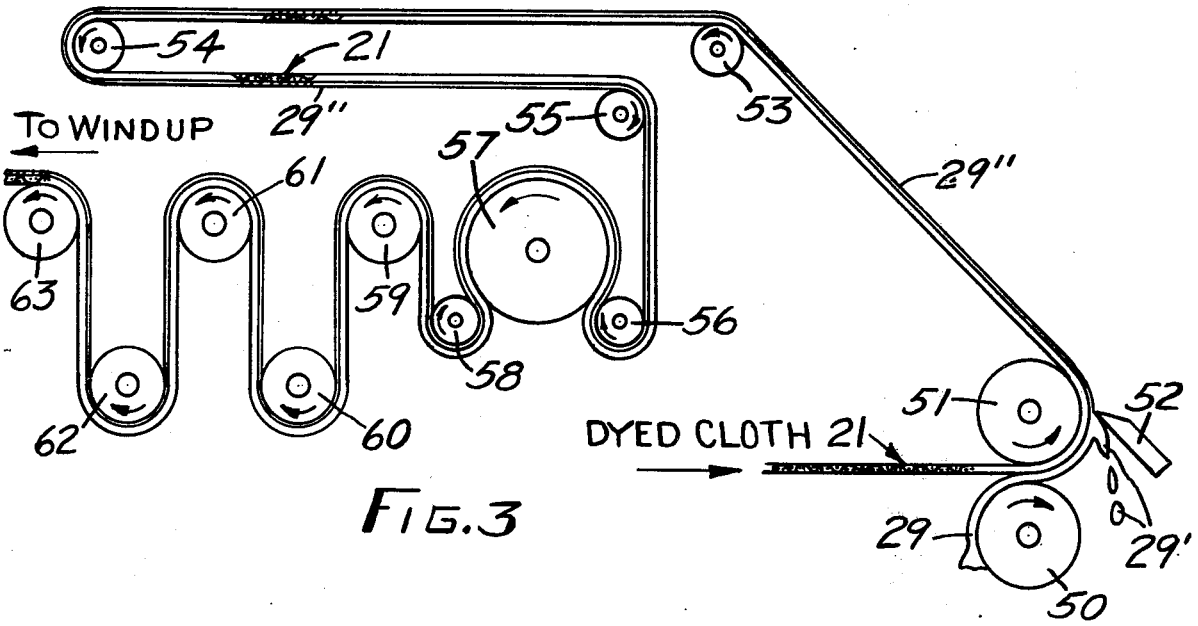
FIGS. 3 and 4 show the presently preferred manner of preparing the cloth backing of the invention.
Figure 4:
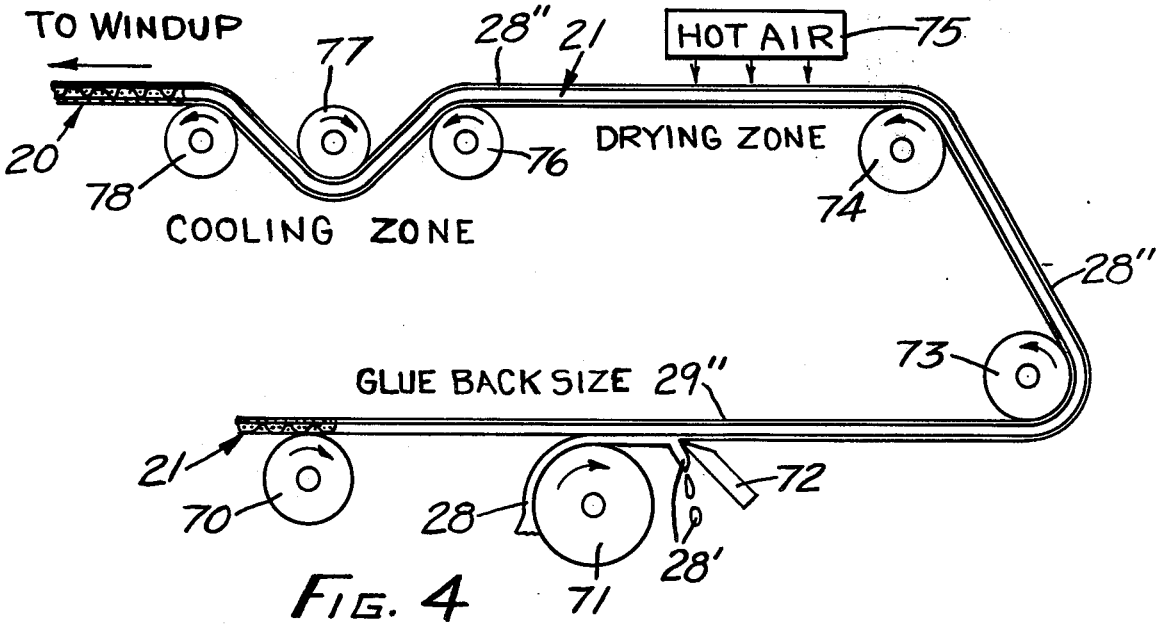

Backing 20 is prepared as shown in FIGS. 3 and 4 of the drawing. Cotton cloth 21 (back side down), after conventional dyeing, drying and draw-down to the desired width, is coated on the back side with a mass of aqueous glue solution 29. The coated cloth is forwarded by roll 51 through the relatively open nip formed by rolls 50, 51 rotating in the direction indicated by the arrows, and operating at the same surface speed.

Roll 50 is rotatably supported in an aqueous glue bath (not shown for sake of clarity) for pick-up of glue solution on its surface and subsequent application of an excess amount thereof to the under or back side of cloth backing 21. Cloth 21 with aqueous glue mass 29 thereon is carried on roll 51 past flexible knife 52 positioned at an angle, as shown, closely adjacent roll 51. Knife 52, the end of which is in contact with the backing, frictionally spreads the aqueous glue solution on the backing while at the same time removing excess glue solution 29' and serves to smooth out glue solution 29 into a continuous layer 29''.

The coated cloth is then forwarded through a hot air oven or the like wherein the layer of glue solution is heated at a temperature and for a time sufficient to provide a glue layer that is dried to a "tack-free" condition. By "tack-free" is meant that on touching with the fingers the glue layer is not tacky.

Heating and drying can be suitably performed, as shown in FIG. 3, by passing the wet cloth backing over rolls 53, 54, 55 and 56, thence in contact with steam-heated roll 57 whereon an initial amount of water is evaporated. The backing is then passed around roll 58, its location being such that in conjunction with roll 56, it ensures contact with a maximum portion of the surface of roll 57.

To provide further and complete drying to the "tack-free" condition, the glue coated cloth is then passed over a plurality of cans represented in the drawing by reference numbers 59, 60, 61, 62 and 63. Cans 59, 61 and 63 are desirably heated while cans 60, 62, to prevent sticking of the glue layer on the roll surface, are cooled, or at least are only at room temperature.

The backing is then forwarded to a wind-up station (not shown) wherein it is wound into rolls in preparation for application of the front size.

It is, of course, essential, to prevent sticking, that during drying the glue solution layer not directly contact the surface of the steam-heated roll 57. By location rolls 53, 54 and 55 in the manner shown, the glue solution layer is prevented from directly contacting the heated surface and allows for better evaporation of water from the glue layer. Moreover, it has been discovered that by providing such rolls, the glue solution temperature can preferably be lowered to less than about 110° F. and desirably lowered to less than 100° F. prior to being subjected to heat to dry. Such lowering of temperature allows for an increase in viscosity, thereby aiding in the prevention of migration into the cloth backing on subsequent heating.

The woven cloth backing, after dyeing and during drying, i.e., prior to application of the aqueous glue solution to the backing, should be processed to provide a draw-down of at least about 2 percent. Preferably, a draw-down of from about 6 percent to about 10 percent is provided. This provides for greater dimensional stability in the backing.

It is important in the practice of the invention that the nip formed by rolls 50, 51 be open. By such is meant that roll 50 be so positioned away from roll 51 that it exerts no pressure on dyed cloth backing 21. A suitable nip opening in processing a conventional cloth backing, e.g., a standard drills cloth, is found to be about ⅛ inch. The important consideration, however, is that cloth backing 21 wipe the aqueous glue solution off the surface of roll 50 and that such roll not push or pound, as before-mentioned, the glue solution into the interstices of the backing.

The concentration of the aqueous glue solution suitable for use in the practice of the invention depends, of course, on the molecular weight of the glue; however, for a 58 m.p. glue, a concentration of from about 50–70 percent, preferably 50–60 percent, glue solids is desired. The viscosity, which can be adjusted at any particular temperature of application by addition of water, can be from about 1,500 cps (Brookfield Viscosimeter, No. 2 spindle, 6 rpm, 140° F.) to about 15,000 cps (Brookfield Viscosimeter, No. 4 spindle at 12 rpm, 140° F.). The preferred viscosity is 2,000±200 cps. A sufficient mass of aqueous glue solution is applied to the cloth backing to provide from about 1.0 to about 4.0 lbs./sandpaper maker's ream (480 sheets, 9 inches×11 inches), preferably 1.7±0.3 lbs./ream.

Spreading of the glue solution is suitably performed by a flexible knife or the like, the angle of which with respect to the cloth and its location on the roll determines the degree of penetration of the backing and the amount of solution remaining thereon. Merely by way of example, a knife, 0.031 inches thick, having a blade of about 1½ inches, positioned so as to make about a 11-degree angle with the horizontal is found suitable in practicing the invention where the amount of glue deposited (dry weight) is about 1.7 lbs. per sandpaper maker's ream.

Glue-coated cloth is unwound (FIG. 4) and is forwarded, front side down, over roll 70 past resin solution applicator roll 71. Roll 71, rotating in the direction indicated by the arrow, and at the same linear speed as the cloth backing, is supported and rotates in a vat (not shown) containing an aqueous solution of a heat-hardenable resin. Aqueous resin solution 28, in an excess amount, is picked up on the surface of applicator roll 71 and is wiped off the roll by the glue-coated cloth, as is shown in FIG. 4 of the drawing.

The resin solution is then spread into a relatively thin continuous layer 28'', while at the same time excess solution 28' is removed by passing the coated cloth backing in contact with a relatively stiff inverted knife 72. Inverted knife 72 is positioned so as to touch the front side of the backing and at an angle therewith as shown in FIG. 4.

The resin solution is spread without filling the interstices and without substantial penetration of the yarns; however, the aqueous solution does slightly penetrate into the surfaces of the yarn directly in contact with the solution. The degree of penetration, as well as the amount of solution deposited, depends upon the angle of knife 72 with respect to the backing. An angle of from about 45° to about 60° (with respect to a perpendicular from the back surface) for a solution having a viscosity of about 1,800 cps to about 2,200 cps is found satisfactory in the practice of the invention. A steel knife, ⅝ inches thick, having a blade of about 1½ inches extending across the full width of the backing, and having a sharp end taper of about 60°, is found to perform suitably.

A suitable heat-hardenable resin for the practice of the invention is phenol-formaldehyde. Such resin provides a layer of front size miscible with the phenol-formaldehyde maker adhesive, but in the uncured stage is not brittle. The resin is readily available commercially in aqueous solution and can be easily adjusted to the desired viscosity at any desired application temperature by the mere addition of water. A filler, such as calcium carbonate, conventionally used with such resin, can be incorporated in the solution so as to provide on a volume basis, preferably about 42 percent of the solids in the resin solution. The viscosity of the aqueous resin solution can be from about 1,500 cps (Brookfield Viscosimeter, No. 2 spindle at 6 rpm, 90° F.) to about 15,000 cps (Brookfield Viscosimeter, No. 4 spindle at 12 rpm, 90° F.). The preferred viscosity is 2,000±200 cps. The weight of resin solution applied to the backing should provide a layer of front size of from about 4.5 to about 7.5 lbs./ream. Preferably, the front size is about 6±0.5 lbs./ream.

Although in the drawing the glue-coated backing is indicated to be in tangential contact with applicator roll 71, such can form a slight wrap on the roll, e.g., ten degrees or so, if desired. A bar or, even preferably, a roll (not shown) can be located between applicator roll 71 and knife 72 to provide for such wrap, which of course makes for better wetting of the backing.

The aqueous resin solution coated cloth is then passed around rolls 73, 74 to a drying zone where the backing is heated to remove water and thereby dry the resin layer.

To avoid migration of the resin front size into the interstices of the backing and unduly into the yarns, it has been found necessary to avoid roll drying and the like. A satisfactory means of drying, it has been discovered, results from impingement of the resin solution layer with a plurality of hot air streams 75 applied laterally across the backing, i.e., perpendicular to the direction of travel of the backing.

The cloth is then passed over and under a plurality of cool cans, represented by reference numerals 76, 77 and 78, to stabilize the heat-hardenable resin layer, thereby preventing unintentional curing of the resin layer. The cloth is then passed to a wind-up station where it is wound in a roll (not shown) in preparation for coated abrasive manufacture in the conventional fashion.

It is important the heat-hardenable resin is not overdried, i.e., subjected to curing conditions. Premature curing makes for poor adhesion later on with the maker adhesive; however, drying should be sufficient to provide a "tack-free" surface (before described) and is necessary to prevent migration by the front size into the cloth backing.

The invention will now be further illustrated by reference to the following specific examples which are not, however, intended to be limiting on the scope thereof.

EXAMPLE I

A standard cotton drills having a thread count of 76×48 (cotton count—12½s warp thread; 18s fill thread) and of such weight that one yard of cloth 60 inches wide weighs 1.38 pounds was prepared for manufacture of a resin bond abrasive cloth backing by first dyeing and drying the same according to conventional techniques well known to those skilled in the coated abrasive industry. The cloth was dyed brown and was "pulled down" during drying to a width of 54½ inches, such representing a 9.0 percent pull-down. The cloth backing was then ready for application of the back size.

The dyed cloth was forwarded at a linear speed of 150 feet per minute on the surface of a carrier roll through the nip formed by such roll and a rubber-surfaced applicator roll, rotating in the same direction of travel as the cloth, and at the same linear speed as the carrier roll in an aqueous glue solution. Glue solution was picked up on the surface of the applicator roll and was wiped from said surface by the cloth backing. A relatively open nip (⅛ inch) between the rolls was provided.

The aqueous glue solution was 51 percent, 58 m.p. glue, was maintained in the glue tank at a temperature of about 140° F., and had a viscosity of approximately 2,200 cps (Brookfield Viscosimeter, No. 2 spindle, 30 rpm, 140° F.).

The newly applied mass of glue solution was then spread and made relatively smooth and continuous and excess glue solution was removed by passing the coated backing in contact with a flexible knife. The knife, the end of which pressed directly against the solution-coated backing, was about 0.031 inches in thickness and extended across the width of the roll. It formed an angle of approximately 16° with respect to the horizontal.

The aqueous glue layer was allowed to cool to a temperature of about 100° F. before being subjected to drying conditions. The glue-coated backing was passed in contact with (aqueous glue solution layer on outboard side) steam-heated steel rolls and was then passed alternately over hot and cold (room temperature) steel cans. With such manner of drying, the glue solution layer was heated for about 43 seconds at 230° F.

The "tack-free" glue-coated cloth was then wound up in a roll in conventional fashion in preparation for application of the front size. The glue solution, applied to the back side of the dyed cloth in excess, was sufficient to provide a weight (dry basis) of about 2.0 lbs. glue per sandpaper maker's ream. The original cloth weighed (dyed) 15.3 lbs. per ream and the glue-coated cloth weighed 17.3 lbs. per ream.

The glue-coated cloth backing was unwound and forwarded at 150 feet per minute past a heat-hardenable resin solution applicator roll. The applicator roll, rotating at a linear speed of 150 feet per minute and in the same direction of travel as the cloth backing, was rotated in an aqueous phenolformaldehyde resin solution having the following composition:

| | Lbs. |
|---|---|
| Varcum 2536 (a phenol-formaldehyde resin aqueous solution purchased from Varcum Chemical Corporation) | 550 |
| $CaCO_3$ | 412 |
| $H_2O$ | 58 |
| | 1,020 |

and a viscosity of 2,100 cps (Brookfield Viscosimeter, No. 2 spindle, 30 rpm, 85° F.).

The resin solution was wiped from the surface of the applicator roll by the backing, after which it was then made relatively smooth and continuous, and excess solution was removed from the backing by passing the newly coated backing across and in contact with an inverted knife.

The knife, which was of stainless steel and about ⅝ inches in thickness, extended across the width of the backing at an angle of about 45° with respect to the leading end of the backing. The knife was tapered at the contact edge to form a bevel of 60°. The beveled edge faced the leading end of the backing.

The aqueous resin layer was then heated for about 4½ seconds by passing the backing under a plurality of hot air streams. The air, heated to a temperature of about 700° F., was directed onto the resin solution layer in 16 streams extending across the width of the backing from a conventional hot air heater located about 4 inches above the surface of the backing.

The backing was then passed over and under a plurality of cool (ambient temperature) cans whereby the temperature of the resin layer was reduced prior to winding. A "tack free", uncured resin layer was provided stabilized against premature curing.

Resin solution, applied to the backing in excess, was sufficient to provide a weight (dry basis) of about 6 lbs./ream front size. The finished backing had a total weight of about 23.6 lbs./ream and a width of 53.5 inches, thus representing a total pull-down of about 10.9 percent.

Upon examination of a cross-section of the finished coated cloth backing under a microscope, the interstices of the backing were observed to be unfilled, and the glue and resin layers were observed to be deposited substantially on the surfaces of the yarns on the respective sides of the backing. The glue and resin layers, while penetrating to a slight degree the surfaces of the yarns, did not contact one another in the interstices of the backing and permitted the yarns freedom of movement.

EXAMPLE II

A standard cotton drills, 60 inches wide, having a yarn count of 76×48, 12½s×18s, was finished according to conventional techniques involving back filling in addition to front and back sizing, to provide a comparison with the unfilled cloth backing according to the invention.

The cloth, after dyeing, was pulled down during drying about 6 percent. The dyed cloth was then back-filled with an aqueous solution of starch and glue on a "Tommy Dodd", well known to those in the cloth finishing industry. The starch-glue solution had a viscosity of more than 100,000 cps and contained 62 percent water, the solid starch and glue being in a weight ratio of 80/20. The wet cloth was then dried for about 48 seconds at 230° F. under tension sufficient to reduce the width of the cloth from 57¾ inches to 54¼ inches, representing a pull-down of about 6 percent. The amount of back fill (dry basis) was 2.7 lbs./ream.

The back-filled cloth was then passed through a conventional two-roll padder, at 155 feet per minute, where an aqueous glue solution containing 35% 58 m.p. glue was applied to the back side of the cloth backing. The glue solution had a viscosity of 170 cps (Brookfield Viscosimeter, No. 2 spindle, 60 rpm, 150° F.). The wet cloth was dried on cans for 43 seconds at 230° F. to provide a "tack-free" glue layer. On a dry basis, the weight of the cloth represented a pick up of about 1.0 lb./ream glue.

The cloth thus treated was then provided with a front size of phenol-formaldehyde filled with calcium carbonate. The dried, back-filled and back-sized cloth backing was passed over a "Tommy Dodd" by which an aqueous phenol-formaldehyde layer was applied to the front side of the backing. The aqueous solution had a viscosity of about 15,000 cps (Brookfield Viscosimeter, No. 4 spindle, 12 rpm, 85° F.) and contained 86% solids by weight, the solids being of the following composition:

| | Per cent |
|---|---|
| Phenol-formaldehyde | 42.5 |
| Calcium carbonate | 57.5 |

The wet cloth was then dried on hot cans for 34 seconds at 230° F. to provide a "tack-free" resin layer. The front size provided was about 6.7 lbs./ream (dry basis). The finished backing had a total weight of about 25.7 lbs./ream.

A cross-section of a sample of this finished backing was prepared according to usual techniques and was examined under a microscope. The glue and resin layers were observed to penetrate into the interstices of the backing and into the yarn surfaces to a much greater extent than in the backing of Example I.

EXAMPLE III

Samples of the backings in Examples I and II were compared for relative pliability and tear strengths.

Four samples (two from each example) were prepared by heating the same for 2 hours in a hot air oven at 250° F. The samples were then conditioned at 50% R.H. for 48 hours.

Two of the prepared samples (one each from Examples I and II) were subjected to tear strength tests according to A.S.T.M. D 1424–59; *Tear Resistance of Woven Fabrics By Falling Pendulum (Elmendorf) Apparatus.*

The other two samples were subjected to pliability tests according to Clash-Berg, *Modern Plastics,* July 1944 at pages 119–124, 160.

The results of the test are given below:

TESTS

| EXAMPLE | TEAR (WARP) $\frac{gm - cm}{cm}$ | PLIABILITY, DEGREES |
|---|---|---|
| 1 | 4320 | 21 |
| 2 | 2488 | 18 |

As can readily be seen from the data, a backing according to the invention provides improved tear strength and pliability.

EXAMPLE IV

The improvement in a coated abrasive utilizing the novel cloth backing of this invention was determined in a heavy grinding pressure operation.

Finished cloth, as in Examples I and II, was coated with abrasive grain according to usual procedures to provide a 50X RESINALL CLOSEKOTE METALITE CLOTH.

To determine if the physical characteristics of a coated abrasive are affected by the sequence in which the front and back size in Example I is applied, a third backing was prepared, however, in this backing the resin front size was applied first.

Each of the coated abrasive products was processed according to conventional techniques to provide a plurality of belts ⅝"×90".

The above belts were separately evaluated, as below described, on a Pratt-Whitney 9" Turbine Blade Automatic Grinder having 9" drive pulley and operating at 8,200 SFPM–3,450 RPM, one inch diameter steel contact wheel. A jet engine blade (Inconel metal), 1½"×4", was clamped in position. The machine was started and the belt lowered until it made contact with the blade. A stream of cutting oil was applied directly on the turbine blade and belt at the grinding point.

Belts having backings according to the invention in which the back size was applied first were judged to provide the better finish and to remove the greater amount of metal.

The procedural sequence in which the back size is applied first is, moreover, preferred to avoid unintentional curing of the resin front size. It is deemed essential for good adhesion between the resin front size and the resin maker adhesive that the front size be merely dried, not cured.

EXAMPLE V

In a manner similar to Example I, a backing was produced; however, the front size solution was applied first and such was dried by traveling the wet backing over hot cans.

The above backing, containing no back fill, was processed according to usual techniques to provide belts of a 36X RESINALL METALITE CLOTH. A backing produced as in Example II was used as a control in the same coated abrasive product. The tear resistance of the backing similar to that in Example I was greater than in the control prior to processing into the coated abrasive product. However, in the coated abrasive product, tear resistance of the two products was found to be comparable. This is believed due to the fact that can drying results in a non-continuous layer of front size. Can drying tends to increase penetration of the size solution into the backing which makes for a relatively porous front size. The maker adhesive, upon application, flows through these pores or openings in the front size, thus decreasing the mobility of the yarns. The lack of yarn mobility results in less tear resistance. Moreover, such maker penetration, because of the lack of back fill, is believed also to be, at least partially, responsible for the less pliable nature of the experimental product compared to the control.

Obviously, many modifications and variations may be made without departing from the spirit and scope of the invention described above and, therefore, only such limitations should be imposed as are contained in the appended claims.

What I claim is as follows:

1. A process for preparing cloth for use as a backing for coated abrasive products comprising the steps of:
   (a) passing a cloth having a front side and a back side and interstices therein, to a liquid polymer coating means, the front side of said cloth contacting said coating means while facing in a downward position relative thereto;
   (b) lightly applying a coating of liquid heat-hardenable resin to said front side in such a manner so as to avoid pushing said coating into said interstices;
   (c) spreading said coating of liquid resin and removing the excess thereof with a wiping motion, thereby forming a continuous layer of liquid resin on the surface of the front side of said cloth without substantial penetrations of said interstices thereof by the liquid resin;
   (d) heating the liquid resin coated cloth to render the coating tack free;
   (e) cooling the resin coated cloth to ambient temperature so as to prevent premature curing of the liquid resin.

2. The process of claim 1 including the steps of:
   (a) passing said cloth to a glue coating means, the back side of the cloth contacting said glue coating means while facing in a downward position relative thereto;
   (b) applying a coating of glue to said back side;
   (c) spreading said coating of said glue and removing the excess thereof, with a wiping motion thereby forming a continuous layer of glue on the surface of the back side of said cloth without substantial penetration of said interstices thereof by the glue thereby leaving the interstices unfilled and the resin and glue coating out of contact with one another; and
   (d) heating the glue coated cloth so as to leave the glue in a tack free condition.

3. The process of claim 2 wherein said heat-hardenable resin is an aqueous solution of a phenol-formaldehyde condensation resin having a viscosity of 85° F. of at least approximately 1,500 centipoises, and said glue in an aqueous solution of hide glue having a viscosity at 140° F. of at least approximately 1,500 centipoises.

4. A process for preparing a coated abrasive, including the steps of providing a cloth backing material having a plurality of warp and fill yarns intersecting with one another forming interstices there-between and said backing material having a front side and a back side, applying a maker adhesive coating on said front side, and depositing abrasive grains on said maker adhesive coating, wherein the improvement comprises:
   (a) passing said cloth backing material to a liquid polymer coating means, the front side of said backing material contacting said coating means while facing in a downward position relative thereto;
   (b) applying a coating of an aqueous solution of a heat-hardenable phenol-formaldehyde resin to said front side, said phenol-formaldehyde resin having a viscosity of from 1500 to 15,000 centipoises;
   (c) spreading said coating of liquid resin and removing the excess thereof with a wiping motion, thereby forming a continuous layer of liquid resin on the surface of the front side in an amount of from 4.5 to 7.5 pounds per sandpaper makers ream, without substantial penetration of said interstices of the cloth backing material by said phenol-formaldehyde resin;
   (d) heating the resin coated backing material to render the coating tack free;
   (e) cooling the resin coated cloth to ambient temperature so as to prevent premature curing of the liquid resin.

5. The process of claim 4 wherein prior to application of the phenol-formaldehyde resin to the front side of said cloth backing material:
   (a) said cloth backing material is passed to a glue coating means, the back side of said backing material contacting said coating means while facing in a downward position relative thereto;
   (b) a coating of an aqueous solution of glue is applied to said back side, said glue being made up of 50 to 70% by weight of hide glue in water and having a viscosity of 1500 to 15,000 centipoises;
   (c) said glue coating is spread and the excess removed by a wiping motion thereby forming a continuous layer of glue on the surface of the back side in an amount of 1 to 4 pounds per sandpaper makers ream, without substantial penetration of said interstices thereof by the glue thereby leaving the interstices unfilled and the resin and glue coatings out of contact with each other; and
   (d) heating and drying the glue coated backing material so as to leave said glue in a tack free condition.

* * * * *